US012604980B2

(12) United States Patent
Chen et al.

(10) Patent No.: US 12,604,980 B2
(45) Date of Patent: Apr. 21, 2026

(54) SLIDE RAIL ASSEMBLY AND METHOD FOR OPENING SLIDE RAIL THEREOF

(71) Applicant: King Slide Technology Co., Ltd., Kaohsiung City (TW)

(72) Inventors: Ken-Ching Chen, Kaohsiung City (TW); Chun-Ta Liu, Kaohsiung City (TW); Hsin-Cheng Su, Kaohsiung City (TW); Chih-Yuan Chang, Kaohsiung City (TW); Shu-Chen Lin, Kaohsiung City (TW)

(73) Assignee: King Slide Technology Co., Ltd., Kaohsiung City (TW)

( * ) Notice: Subject to any disclaimer, the term of this patent is extended or adjusted under 35 U.S.C. 154(b) by 224 days.

(21) Appl. No.: 18/435,863

(22) Filed: Feb. 7, 2024

(65) Prior Publication Data

US 2025/0057313 A1 Feb. 20, 2025

(30) Foreign Application Priority Data

Aug. 16, 2023 (TW) ..... 112131047

(51) Int. Cl.
*A47B 88/457* (2017.01)
*A47B 88/46* (2017.01)

(52) U.S. Cl.
CPC ..... *A47B 88/457* (2017.01); *A47B 88/46* (2017.01)

(58) Field of Classification Search
CPC ..... A47B 88/457; A47B 88/463; A47B 88/46
See application file for complete search history.

(56) References Cited

U.S. PATENT DOCUMENTS

| | | | | |
|---|---|---|---|---|
| 10,172,459 | B2 * | 1/2019 | Chen | A47B 88/463 |
| 12,404,897 | B2 * | 9/2025 | Nußbaumer | A47B 88/45 |
| 2022/0015537 | A1 * | 1/2022 | Janser | A47B 88/463 |
| 2023/0295962 | A1 * | 9/2023 | Chen | A47B 88/463 312/216 |
| 2025/0295232 | A1 * | 9/2025 | Peterlunger | A47B 88/46 |

FOREIGN PATENT DOCUMENTS

| | | | |
|---|---|---|---|
| EP | 1716781 | A2 | 11/2006 |
| WO | 2021043756 | A1 | 3/2021 |
| WO | 2021/180516 | A1 | 9/2021 |

OTHER PUBLICATIONS

English translation of WO 2021/180516 from espacenet (Year: 2025).*

* cited by examiner

*Primary Examiner* — Daniel J Rohrhoff
(74) *Attorney, Agent, or Firm* — Best & Flanagan LLP

(57) ABSTRACT

A slide rail assembly includes a first rail, a second rail, an elastic member, a movable member and an electronic module. The second rail is movable relative to the first rail. When the second rail is located at a retracted position relative to the first rail and when the movable member is in a locking state, the elastic member is configured to be locked to accumulate the elastic force. The electronic module includes a driving device configured to drive the movable member to switch from the locking state to an unlocking state, in order to release the elastic force of the elastic member, such that the second rail is moved from the retracted position along an opening direction relative to the first rail in response to the elastic force of the elastic member.

20 Claims, 13 Drawing Sheets

SLIDE RAIL ASSEMBLY AND METHOD FOR OPENING SLIDE RAIL THEREOF

BACKGROUND OF THE INVENTION

1. Field of the Invention

The present invention relates to a slide rail assembly, and more particularly, to a slide rail assembly having a slide rail configured to be opened through electric driving.

2. Description of the Prior Art

In a furniture system, such as a cabinet, a drawer can be opened or closed relative to a cabinet body through a pair of slide rail assemblies. Currently, there is a so called push-open product having a drawer capable of being opened from a retracted position relative to a cabinet body by releasing an elastic force of an elastic member (such as a spring). U.S. Pat. No. 10,172,459 B2 discloses a slide rail assembly with the aforementioned push-open function, and a movable rail of the slide rail assembly is arranged with a synchronization device configured to be connected to a synchronization rod for synchronously moving the movable rail with a movable rail of another slide rail assembly.

In addition, patent number WO2021/043756A1 discloses a piece of furniture comprising a furniture carcass and at least one movable furniture part. The movable furniture part is movable via a movement fitting between a closed position and an open position. A locking device is configured to retain the movable furniture part in the closed position via a permanent magnet on the furniture carcass. A triggering device is provided, by means of which the locking device can be disabled, in order to move the movable furniture part in the opening direction. The triggering device has an electromagnet, which can be switched via a controller in order to open the movable furniture part from the closed position. As a result, the movable furniture part can be triggered by minor forces.

For different market requirements, sometimes a slide rail assembly or a furniture part (such as a drawer or a door panel) is not required to be opened by the aforementioned ways. Therefore, it is important to develop various slide rail products.

SUMMARY OF THE INVENTION

The present invention provides a slide rail assembly having a slide rail configured to be opened through electric driving.

According to an embodiment of the present invention, a slide rail assembly comprises a first rail, a second rail, an elastic member, a movable member and an electronic module. The second rail is movable relative to the first rail. The elastic member is configured to generate an elastic force in response to the second rail being located at a retracted position relative to the first rail. When the second rail is located at the retracted position relative to the first rail and when the movable member is in a locking state, the elastic member is configured to be locked to accumulate the elastic force. The electronic module comprises a driving device configured to drive the movable member to switch from the locking state to an unlocking state, in order to release the elastic force of the elastic member, such that the second rail is moved from the retracted position along an opening direction relative to the first rail in response to the elastic force of the elastic member.

According to another embodiment of the present invention, a method for opening a slide rail of a slide rail assembly comprises providing a slide rail assembly comprising a first rail, a second rail and an elastic member; providing a movable member in a locking state arranged on the second rail to lock the elastic member in order to accumulate an elastic force of the elastic member; providing an electronic module arranged on the first rail, wherein the electronic module comprises a driving device; and linking a communication device to the electronic module to control the driving device to drive the movable member to switch to an unlocking state, in order to release the elastic force of the elastic member, such that the second rail is moved away from a retracted position relative to the first rail in response to the elastic force of the elastic member.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
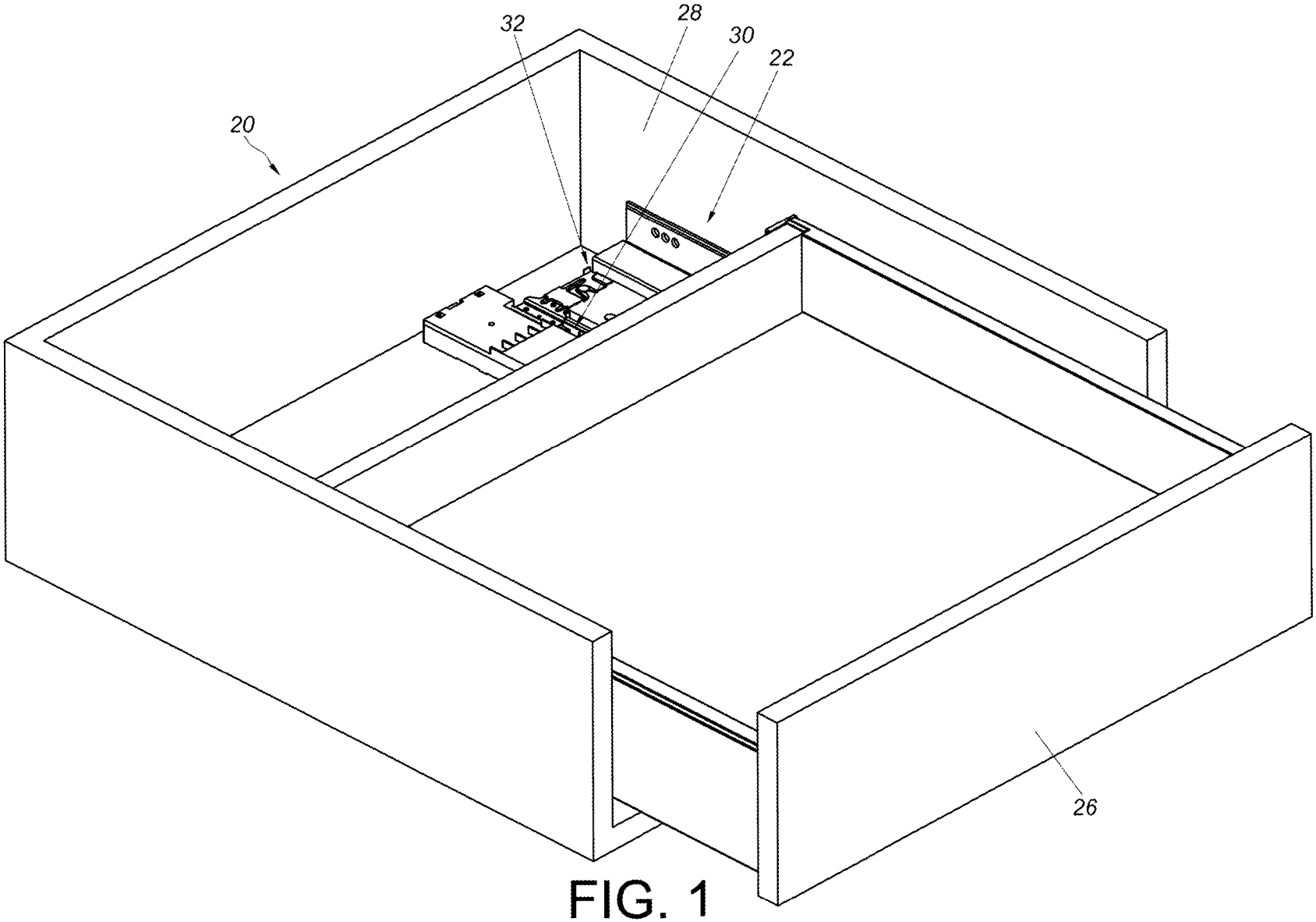
FIG. 1 is a diagram showing a furniture system comprising at least one drawer and a cabinet body according to a first embodiment of the present invention.
Figure 2:
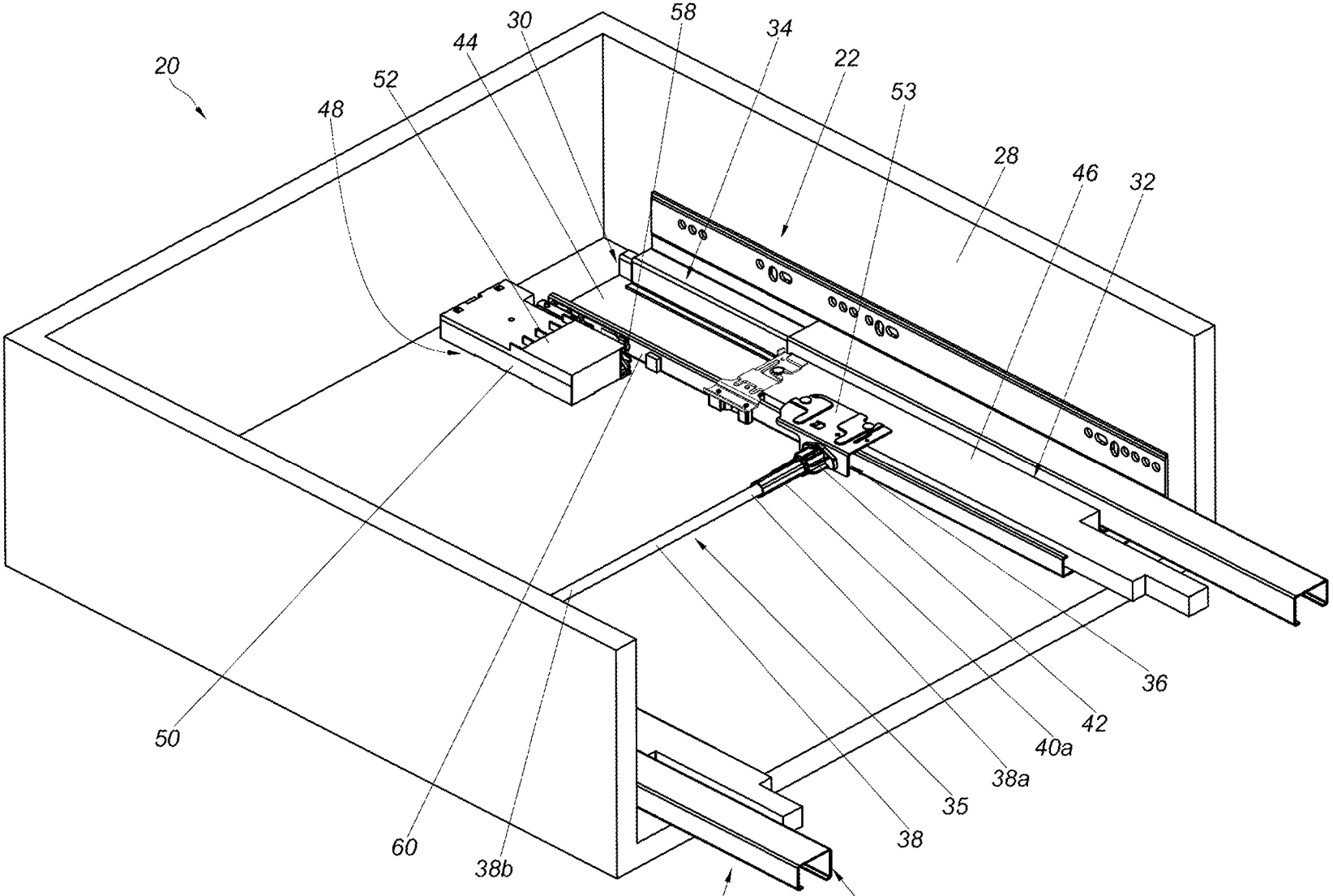
FIG. 2 is a diagram showing the furniture system comprising a synchronization device arranged between two slide rail assemblies on the cabinet body according to the first embodiment of the present invention.

As shown in FIG. 1 and FIG. 2, a furniture system 20 comprises a first slide rail assembly 22, a second slide rail assembly 24, a drawer 26 and a cabinet body 28. The first slide rail assembly 22 and the second slide rail assembly 24 are configured to mount the drawer 26 to the cabinet body 28, in order to allow the drawer 26 to be movable relative to the cabinet body 28 through the first slide rail assembly 22 and the second slide rail assembly 24.

The first slide rail assembly 22 and the second slide rail assembly 24 have substantially identical structural configuration. More particularly, each of the first slide rail assembly 22 and the second slide rail assembly 24 comprises a first rail 30 and a second rail 32 longitudinally movable relative to the first rail 30. Preferably, each of the first slide rail assembly 22 and the second slide rail assembly 24 further comprises a third rail 34 movably mounted between the first rail 30 and the second rail 32 and configured to extend a moving distance of the second rail 32 relative to the first rail 30. The first rail 30 is fixedly mounted on the cabinet body 28, and the second rail 32 is configured to carry the drawer 26. The furniture system 20 further comprises a synchronization mechanism 35. The synchronization mechanism 35 comprises a first synchronization device 36 and a second synchronization device (not shown in figures due to the viewing angle). The first synchronization device 36 and the second synchronization device have substantially identical structural configuration. Furthermore, the first synchronization device 36 is arranged on the second rail 32 of the first slide rail assembly 22, and the second synchronization device is arranged on the second rail 32 of the second slide rail assembly 24, such that the second rail 32 of the first slide rail assembly 22 and the second rail 32 of the second slide rail assembly 24 can be moved synchronously, in order to increase moving stability of the two second rails 32. The synchronization mechanism 35 further comprises a synchronization rod 38 detachably mounted between the first synchronization device 36 and the second synchronization device. A first end part 38*a* of the synchronization rod 38 is detachably connected to a first movable member 42 of the first synchronization device 36 through a first connecting base 40*a*; similarly, a second end part 38*b* of the synchronization rod 38 is detachably connected to a second movable member (not shown in figures due to the viewing angle) of the second synchronization device through a second connecting base.

Preferably, the first rail 30 comprises an extension part 44, and the second rail 32 comprises a carrying part 46.

Figure 3:
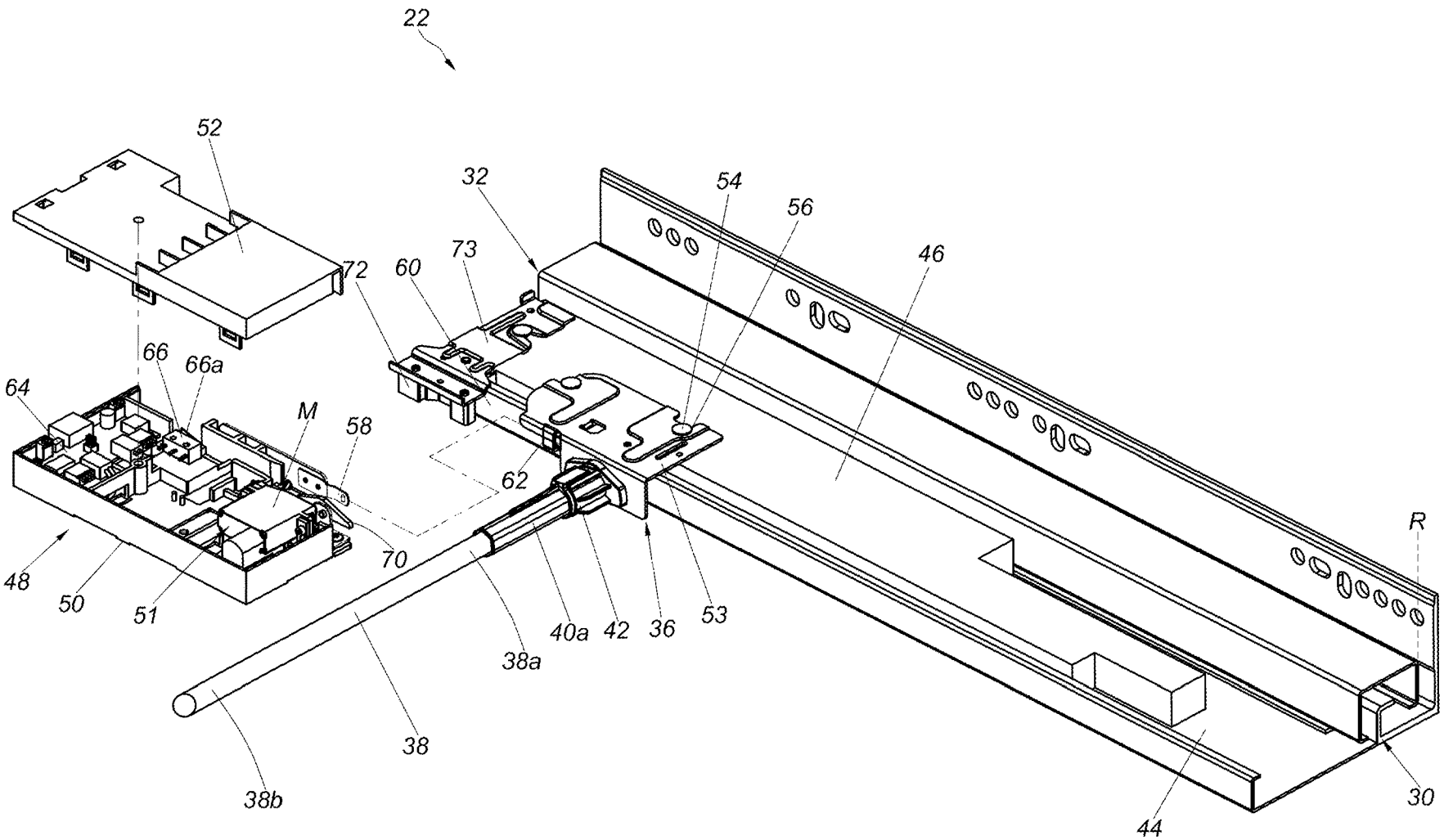
FIG. 3 is an exploded view of the slide rail assembly and an electronic module according to the first embodiment of the present invention.

As shown in FIG. 3, the first slide rail assembly 22 is in a retracted state. More particularly, the second rail 32 is located at a retracted position R relative to the first rail 30. When the second rail 32 is located at the retracted position R, the carrying part 46 of the second rail 32 corresponds to the extension part 44 of the first rail 30. For example, the carrying part 46 of the second rail 32 is located above the extension part 44 of the first rail 30.

The first slide rail assembly 22 further comprises an electronic module 48. Preferably, the electronic module 48 is arranged on the first rail 30. In the present embodiment, the electronic module 48 is detachably mounted on the first rail 30, such that a user can additionally install the electronic module 48 according to requirements. Preferably, the electronic module 48 comprises a base 50 and a cover body 52. The base 50 is configured to carry related electronic components or electronic devices. The cover body 52 is configured to cover and protect the aforementioned electronic components or electronic devices.

The electronic module 48 further comprises a driving device 51 configured to work with the first movable member 42.

Preferably, the first synchronization device 36 further comprises a first fitting member 53, and the first movable member 42 is detachably mounted to the carrying part 46 of the second rail 32 through the first fitting member 53. For example, the carrying part 46 of the second rail 32 comprises at least one first connecting feature 54, and the first fitting member 53 comprises at least one second connecting feature 56. In the present embodiment, the first connecting feature 54 and the second connecting feature 56 respectively are protrusion and slot detachably engaged with each other, but the present invention is not limited thereto.

Preferably, the first movable member 42 is rotatably mounted on the second rail 32. In the present embodiment, the first movable member 42 is rotatably mounted on the first fitting member 53 on the carrying part 46 of the second rail 32.

Preferably, the electronic module 48 is detachably mounted to a second mounting feature 62 of a side wall 60 of the extension part 44 of the first rail 30 through a first mounting feature 58 of the base 50. In the present embodiment, the first mounting feature 58 and the second mounting feature 62 respectively are extension object and insertion slot detachably engaged with each other, but the present invention is not limited thereto.

Preferably, the electronic module 48 further comprises a control circuit board 64 and a position sensor 66. The driving device 51 and the position sensor 66 are electrically connected to the control circuit board 64, and the driving device 51 comprises a motor M. In the first embodiment, the motor M is a servo motor.

Preferably, the electronic module 48 further comprises a signal transceiver unit and a power supply unit (not shown). The signal transceiver unit is configured to receive and/or transmit wireless signals, and the power supply unit is configured to supply power.

Figure 4:
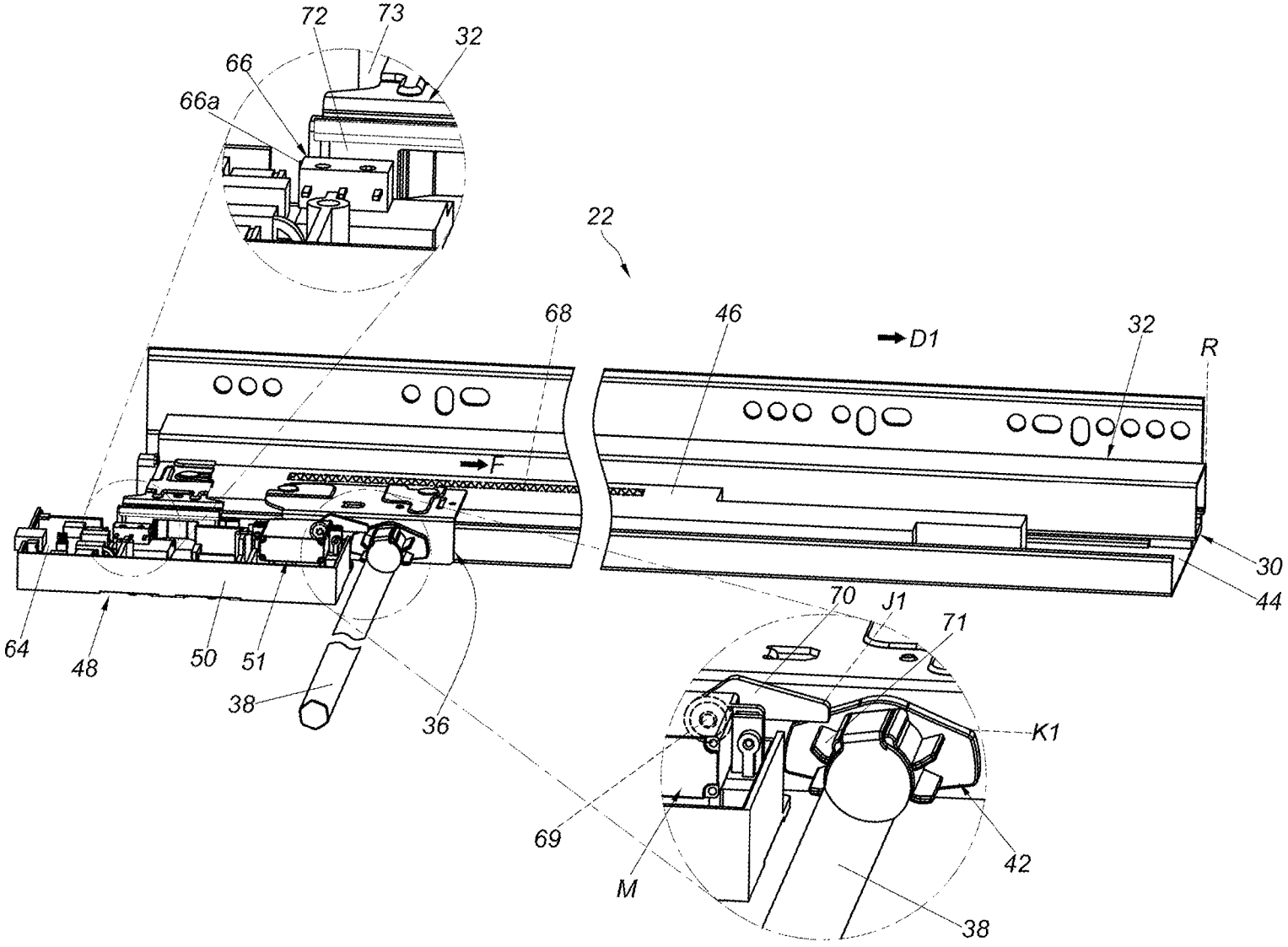
FIG. 4 is a diagram showing a second rail located at a retracted position relative to a first rail of the slide rail assembly according to the first embodiment of the present invention.

As shown in FIG. 4 (the first connecting base 40*a* and the cover body 52 of the electronic module 48 are omitted in FIG. 4), the first slide rail assembly 22 further comprises an elastic member 68, such as a spring. The elastic member 68 is configured to generate an elastic force F along an opening direction D1 in response to the second rail 32 being located at the retracted position R relative to the first rail 30. The second rail 32 is configured to be opened relative to the first rail 30 by the elastic force F of the elastic member 68. In other words, the second rail 32 (the drawer 26) can be ejected to be opened relative to the first rail 30 (the cabinet body 28). Preferably, the elastic member 68 can be arranged at a bottom of the carrying part 46 of the second rail 32.

Moreover, when the second rail 32 is located at the retracted position R relative to the first rail 30 and when the first movable member 42 is in a locking state K1, the elastic member 68 is configured to be locked to accumulate the elastic force F. For example, when the second rail 32 is located at the retracted position R relative to the first rail 30, the elastic member 68 is configured to be directly locked by the first movable member 42 in order to accumulate the elastic force F; or when the second rail 32 is located at the retracted position R relative to the first rail 30, the elastic member 68 is configured to be locked by a locking member arranged at the bottom of the carrying part 46 of the second rail 32 in order to accumulate the elastic force F, and the first movable member 42 can be further moved to drive the locking member to release the elastic force F of the elastic member 68. Such configuration is well known to those skilled in the art, no further illustration is provided for simplification.

In addition, in the first embodiment, a rotating shaft 69 of the driving device 51 (such as a rotating shaft of the motor M) is arranged with a driving member 70, such as a cam, but the present invention is not limited thereto. Furthermore, when the second rail 32 is located at the retracted position R relative to the first rail 30, the rotating shaft 69 is located at an origin position, and the driving member 70 in FIG. 4 is located at an initial position J1 relative to the rotating shaft 69. When the first movable member 42 is in the locking state K1 and when the driving member 70 is located at the initial position J1, the driving member 70 is adjacent to a working part 71 of the first movable member 42.

Preferably, the position sensor 66 is configured to detect whether the second rail 32 is located at the retracted position R relative to the first rail 30. For example, the second rail 32 comprises a predetermined part 72, and the predetermined part 72 of the second rail 32 corresponds to the position sensor 66 when the second rail 32 is located at the retracted position R. The position sensor 66 can be a contact type or non-contact type sensor to work with the predetermined part 72 of the second rail 32, but the present invention is not limited thereto.

Preferably, the first slide rail assembly 22 further comprises a second fitting member 73, and the second fitting member 73 is detachably mounted on the carrying part 46 of the second rail 32. The second fitting member 73 comprises the predetermined part 72; or, the predetermined part 72 can be directly integrated into the carrying part 46 of the second rail 32, but the present invention is not limited thereto.

Figure 5:
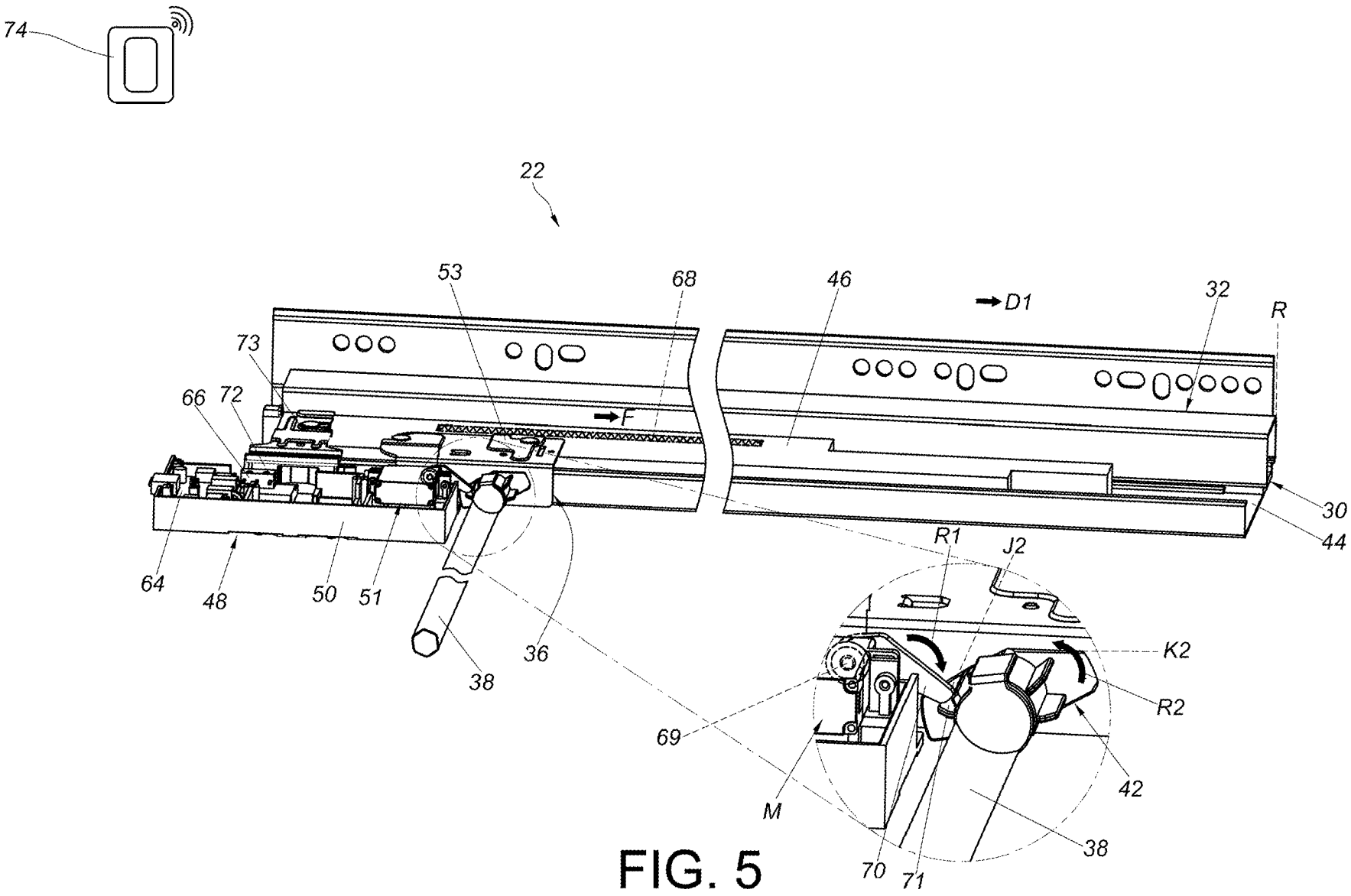
FIG. 5 is a diagram showing the second rail located at the retracted position relative to the first rail of the slide rail assembly and a user trying to operate a communication device to control the electronic module to move the second rail away from the retracted position according to the first embodiment of the present invention.
Figure 6:
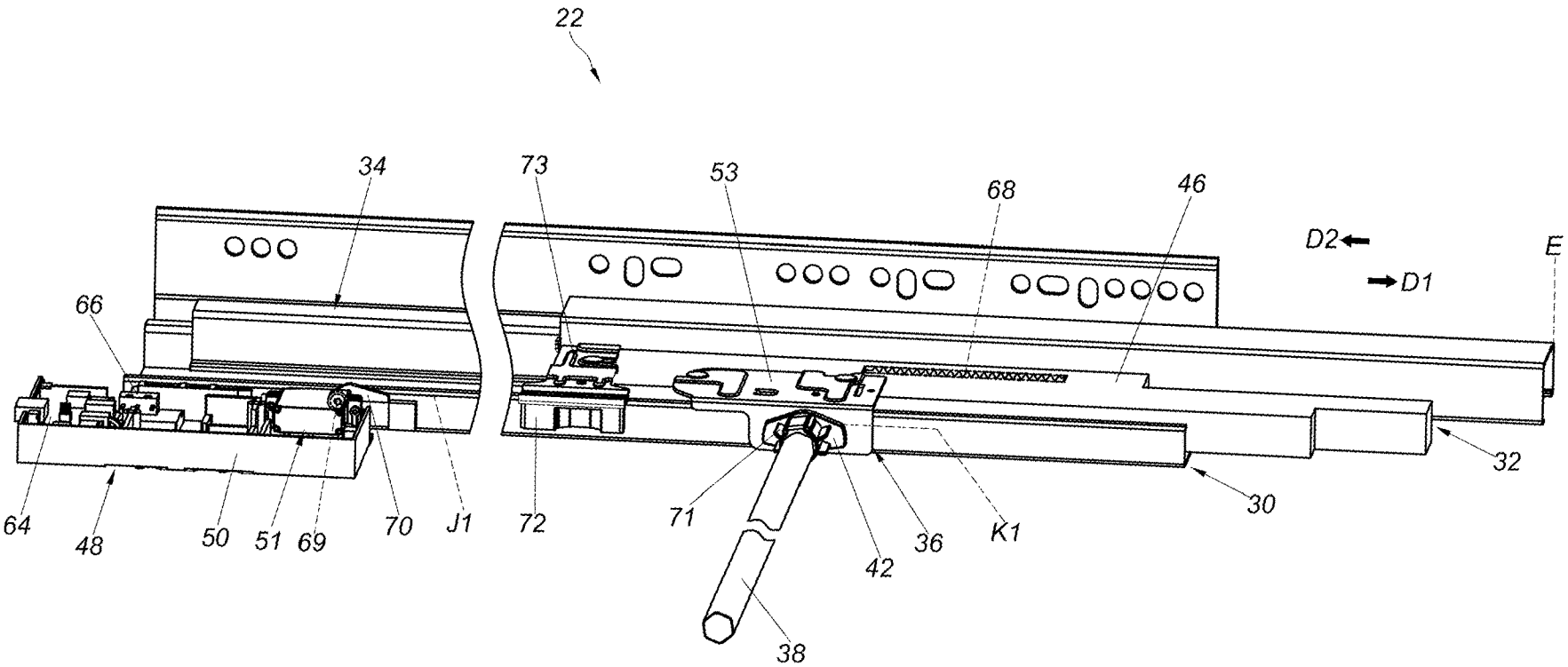
FIG. 6 is a diagram showing the second rail being moved from the retracted position to a predetermined open position relative to the first rail of the slide rail assembly according to the first embodiment of the present invention.

As shown in FIG. 5 and FIG. 6, the driving device 51 is configured to drive the first movable member 42 to switch from the locking state K1 to an unlocking state K2 (as shown in FIG. 5), in order to release the elastic force F of the elastic member 68, such that the second rail 32 is moved from the retracted position R (as shown in FIG. 5) along the opening direction D1 relative to the first rail 30 in response to the elastic force F of the elastic member 68, to be further moved to a predetermined opening position E (as shown in FIG. 6). As such, the predetermined part 72 of the second rail 32 no longer corresponds to the position sensor 66 (the predetermined part 72 of the second rail 32 is away from the position sensor 66). Therefore, the position sensor 66 can detect that the second rail 32 (the drawer 26) is moved away from the retracted position R.

Furthermore, the user can operate a communication device 74 to link to the electronic module 48 (as shown in FIG. 5), in order to control the motor M of the driving device 51 to drive the first movable member 42 to switch from the locking state K1 to the unlocking state K2, such that the second rail 32 (the drawer 26) is driven to move away from the retracted position R along the opening direction D1 (as shown in FIG. 6) relative to the first rail 30 (the cabinet body 28) in response to the elastic force F of the elastic member 68.

Preferably, the communication device 74 can be a mobile phone, a tablet or a smart wearable device, but the present invention is not limited thereto.

Preferably, through the rotating shaft 69 of the motor M driving the driving member 70 to rotate from the initial position J1 to a predetermined angle position J2 along a first rotating direction R1, the driving member 70 is correspondingly moved to the predetermined angle position J2 to contact the working part 71 of the first movable member 42, such that the driving member 70 is configured to drive the first movable member 42 to rotate to switch from the locking state K1 to the unlocking state K2 along a second rotating direction R2, so as to release the elastic force F of the elastic member 68. The first rotating direction R1 is opposite to the second rotating direction R2 (as shown in FIG. 5). For example, the first rotating direction R1 is the clockwise direction, the second rotating direction R2 is the counter-clockwise direction, but the present invention is not limited thereto.

Preferably, the first fitting member 53 of the first synchronization device 36 is arranged with a return elastic component (not shown in figures). When the second rail 32 is located at the predetermined opening position E relative to the first rail 30 (as shown in FIG. 6), the first movable member 42 is configured to return to the locking state K1 from the unlocking state K2 (as shown in FIG. 6) in response to a return elastic force provided by the return elastic component. On the other hand, the position sensor 66 is configured to generate a first signal or a second signal according to the position of the second rail 32 relative to the first rail 30. For example, the position sensor 66 is configured to generate the first signal when the second rail 32 (the drawer 26) is located at the retracted position R relative to the first rail 30 (the cabinet body 28); and the position sensor 66 is configured to generate the second signal when the second rail 32 (the drawer 26) is moved away from the retracted position R relative to the first rail 30 (the cabinet body 28). The rotating shaft 69 of the driving device 51 is configured to return to the origin position according to the second signal (for indicating that the second rail 32 is moved away from the retracted position R relative to the first rail 30) generated by the position sensor 66, such that the driving member 70 is correspondingly moved back to the initial position J1 (as shown in FIG. 6) from the predetermined angle position J2.

Preferably, the communication device 74 and the electronic module 48 are wirelessly linkable to each other, but the present invention is not limited thereto.

More particularly, when the second rail 32 (the drawer 26) is moved from the predetermined opening position E along a retracting direction D2 (as shown in FIG. 6) relative to the first rail 30 (the cabinet body 28) to return to the retracted position R, the elastic member 68 is configured to be locked to accumulate the elastic force F again. Such configuration is well known to those skilled in the art, no further illustration is provided for simplification.

Figure 7:
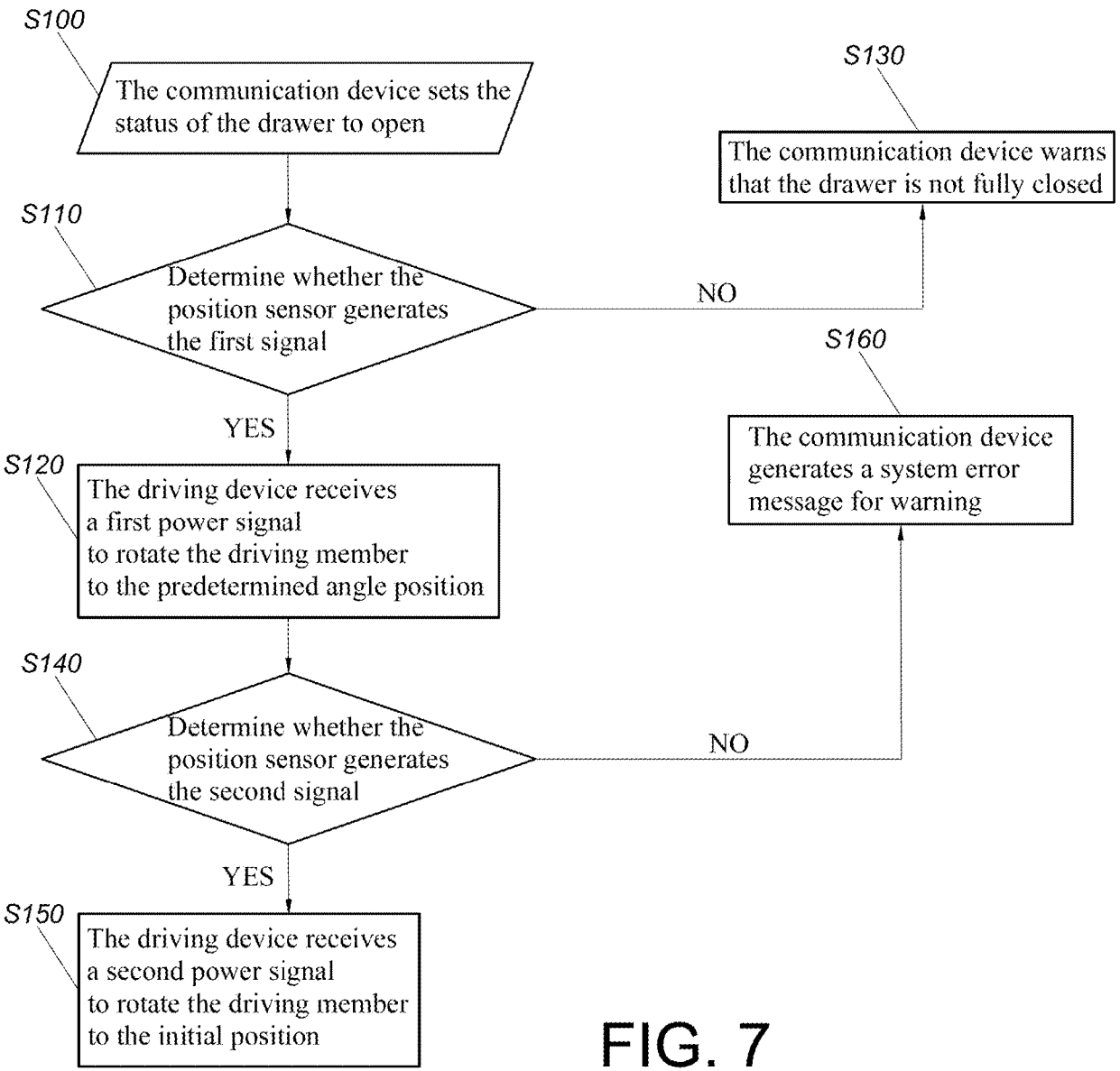
FIG. 7 is a flow chart showing operating processes of the furniture system according to the first embodiment of the present invention.

FIG. 7 is a flow chart showing operating processes of the furniture system 20 according to the first embodiment of the present invention.

Step S100: The communication device sets the status of the drawer to open.

In the step S100, the communication device 74 can be installed with an application (app) to link to the electronic module 48 (the control circuit board 64 of the electronic module 48) for wireless communication. The user can transmit a predetermined signal to the electronic module 48 through the application of the communication device 74

(please refer to FIG. 5). As such, the status of the second rail 32 (the drawer 26) can be set to open. In the present embodiment, the communication device 74 is configured to be linked to the electronic module 48 wirelessly through the application. The application can has functions such as voice recognition, Near-Field Communication (NFC) or fingerprint recognition, but the present invention is not limited thereto.

Step S110: Determine whether the position sensor generates the first signal.

In the step S110, the control circuit board 64 of the electronic module 48 is configured to determine whether the position sensor 66 generates the first signal (as shown in FIG. 4). For example, when the predetermined part 72 of the second rail 32 presses an elastic sensing part 66*a* of the position sensor 66 (please refer to FIG. 3), the position sensor 66 is configured to generate the first signal to the control circuit board 64, to indicate that the second rail 32 (the drawer 26) is currently located at the retracted position R relative to the first rail 30 (the cabinet body 28).

If the control circuit board 64 of the electronic module 48 determines that the position sensor 66 generates the first signal, then go to step S120: The driving device receives a first power signal to rotate the driving member 70 to the predetermined angle position. In the step S120, when the second rail 32 (the drawer 26) is located at the retracted position R relative to the first rail 30 (the cabinet body 28), and when the electronic module 48 receives the predetermined signal from the communication device 74 (as shown in FIG. 5), the control circuit board 64 controls the driving device 51 to receive the first power signal, such that the rotating shaft 69 of the motor M of the driving device 51 drives the driving member 70 to rotate to the predetermined angle position J2, in order to further drive the first movable member 42 to switch to the unlocking state K2, so as to release the elastic force F of the elastic member 68.

If the control circuit board 64 of the electronic module 48 determines that the position sensor 66 does not generate the first signal, then go to step S130: The communication device warns that the drawer is not fully closed. In the step S130, if the position sensor 66 does not generate the first signal, the control circuit board 64 is configured to notify the communication device 74 to generate a warning sound and/or an electronic message through the application to let the user know that the second rail 32 (the drawer 26) currently is not located at the retracted position R relative to the first rail 30 (the cabinet body 28).

After the step S120, go to step S140: Determine whether the position sensor generates the second signal. In the step S140, the control circuit board 64 of the electronic module 48 is configured to determine whether the position sensor 66 generates the second signal (as shown in FIG. 6). For example, when the predetermined part 72 of the second rail 32 does not press the elastic sensing part 66*a* of the position sensor 66, the position sensor 66 is configured to generate the second signal to the control circuit board 64, to indicate that the second rail 32 (the drawer 26) is currently moved away from the retracted position R relative to the first rail 30 (the cabinet body 28) in response to the elastic force F of the elastic member 68. In other words, the second rail 32 (the drawer 26) is moved along the opening direction D1 to the predetermined opening position E.

If the control circuit board 64 of the electronic module 48 determines that the position sensor 66 generates the second signal, then go to step S150: The driving device receives a second power signal to rotate the driving member 70 to the initial position J1. In the step S150, when the position sensor 66 generates the second signal, the control circuit board 64 controls the driving device 51 to receive the second power signal, such that the rotating shaft 69 of the motor M of the driving device 51 drives the driving member 70 to rotate to the initial position J1 (please refer to FIG. 6). In other words, when the position sensor 66 generates the second signal, it means that the second rail 32 (the drawer 26) is currently located at the predetermined opening position E.

If the control circuit board 64 of the electronic module 48 determines that the position sensor 66 does not generate the second signal, then go to step S160: The communication device generates a system error message for warning. In the step S160, if the position sensor 66 does not generate the second signal, it means that the second rail 32 (the drawer 26) is not moved away from the retracted position R. The control circuit board 64 is configured to notify the communication device 74 to generate a system error message, such as a warning sound and/or an electronic message, through the application to let the user know that the second rail 32 (the drawer 26) currently is not moved away from the retracted position R relative to the first rail 30 (the cabinet body 28).

Figure 8:
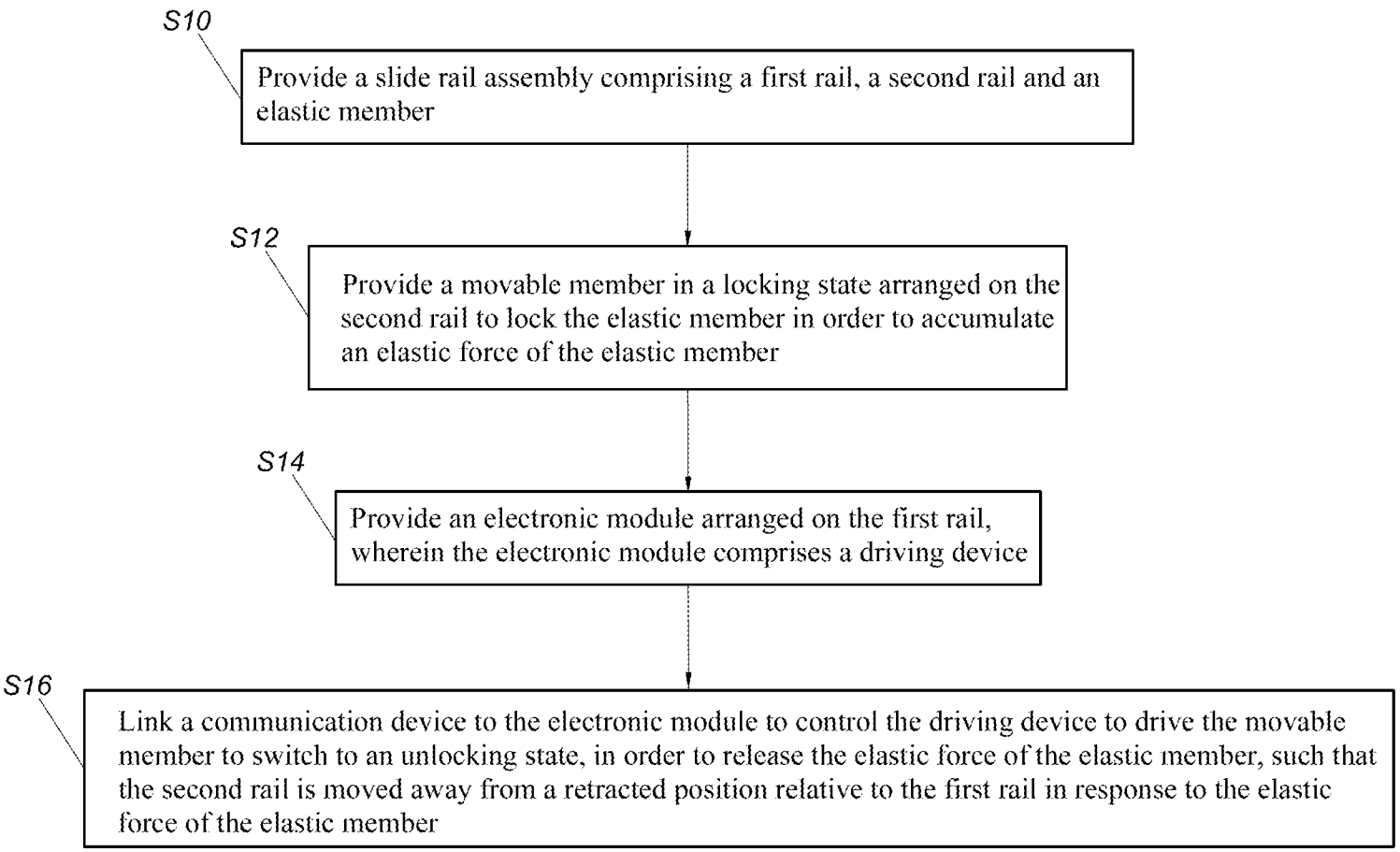
FIG. 8 is a flow chart showing a method for opening the second rail of the slide rail assembly according to the first embodiment of the present invention.

FIG. 8 is a flow chart showing a method for opening the second rail 32 relative to the first rail 30 of the slide rail assembly 22 according to the first embodiment of the present invention. The method comprises the following steps:

Step S10: Provide a slide rail assembly 22 comprising a first rail 30, a second rail 32 and an elastic member 68 (please refer to FIG. 4).

Step S12: Provide a movable member 42 in a locking state K1 arranged on the second rail 32 to lock the elastic member 68 in order to accumulate an elastic force F of the elastic member 68 (please refer to FIG. 4).

Step S14: Provide an electronic module 48 arranged on the first rail 30, wherein the electronic module 48 comprises a driving device 51 (please refer to FIG. 4).

Step S16: Link a communication device 74 to the electronic module 48 to control the driving device 51 to drive the movable member 42 to switch to an unlocking state K2 (please refer to FIG. 5), in order to release the elastic force F of the elastic member 68, such that the second rail 32 is moved away from a retracted position R relative to the first rail 30 in response to the elastic force F of the elastic member 68 (please refer to FIG. 5 and FIG. 6).

Details of the method have been disclosed above, no further illustration is provided for simplification.

Figure 9:
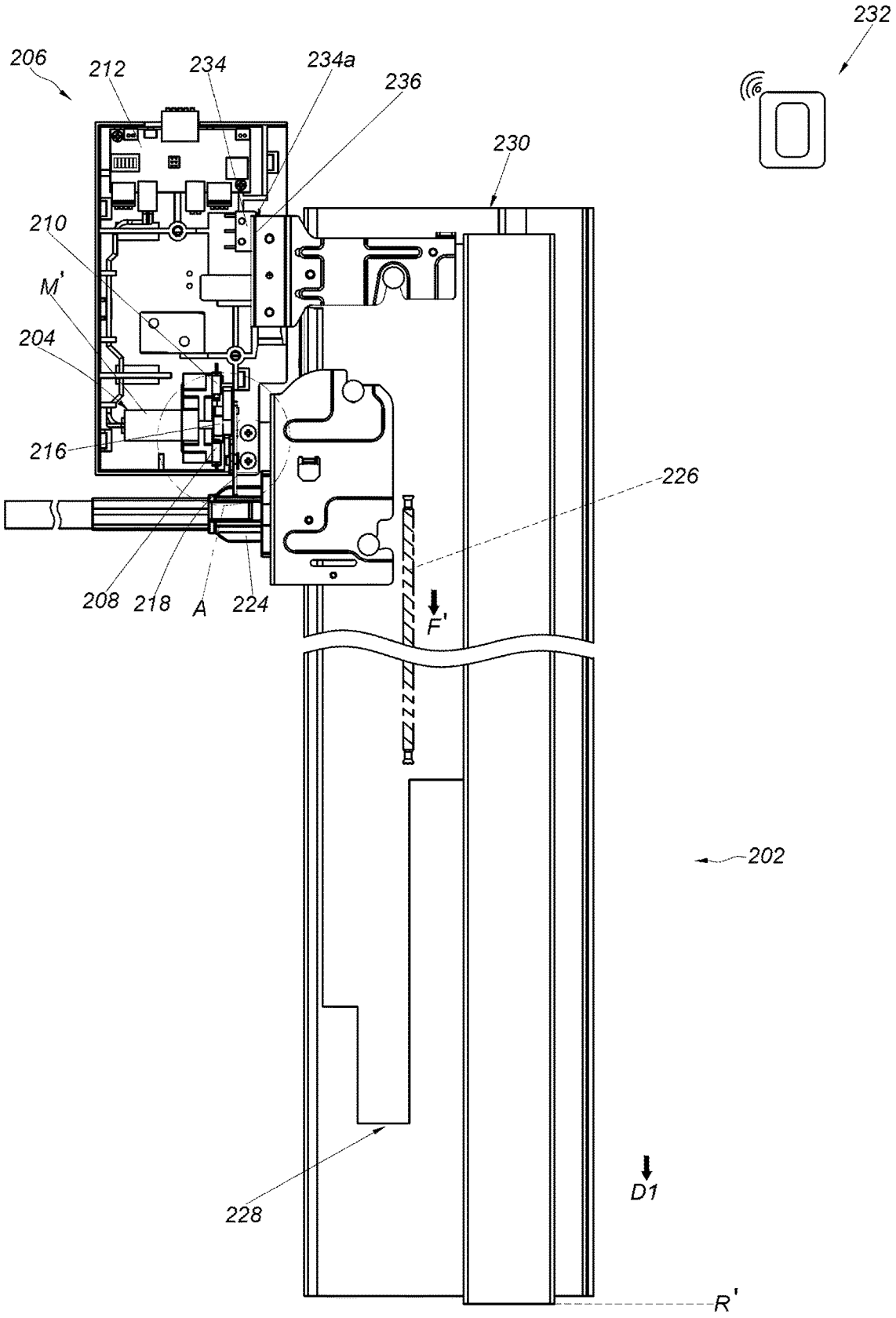
FIG. 9 is a diagram showing a second rail located at a retracted position relative to a first rail of a slide rail assembly according to a second embodiment of the present invention.
Figure 10:
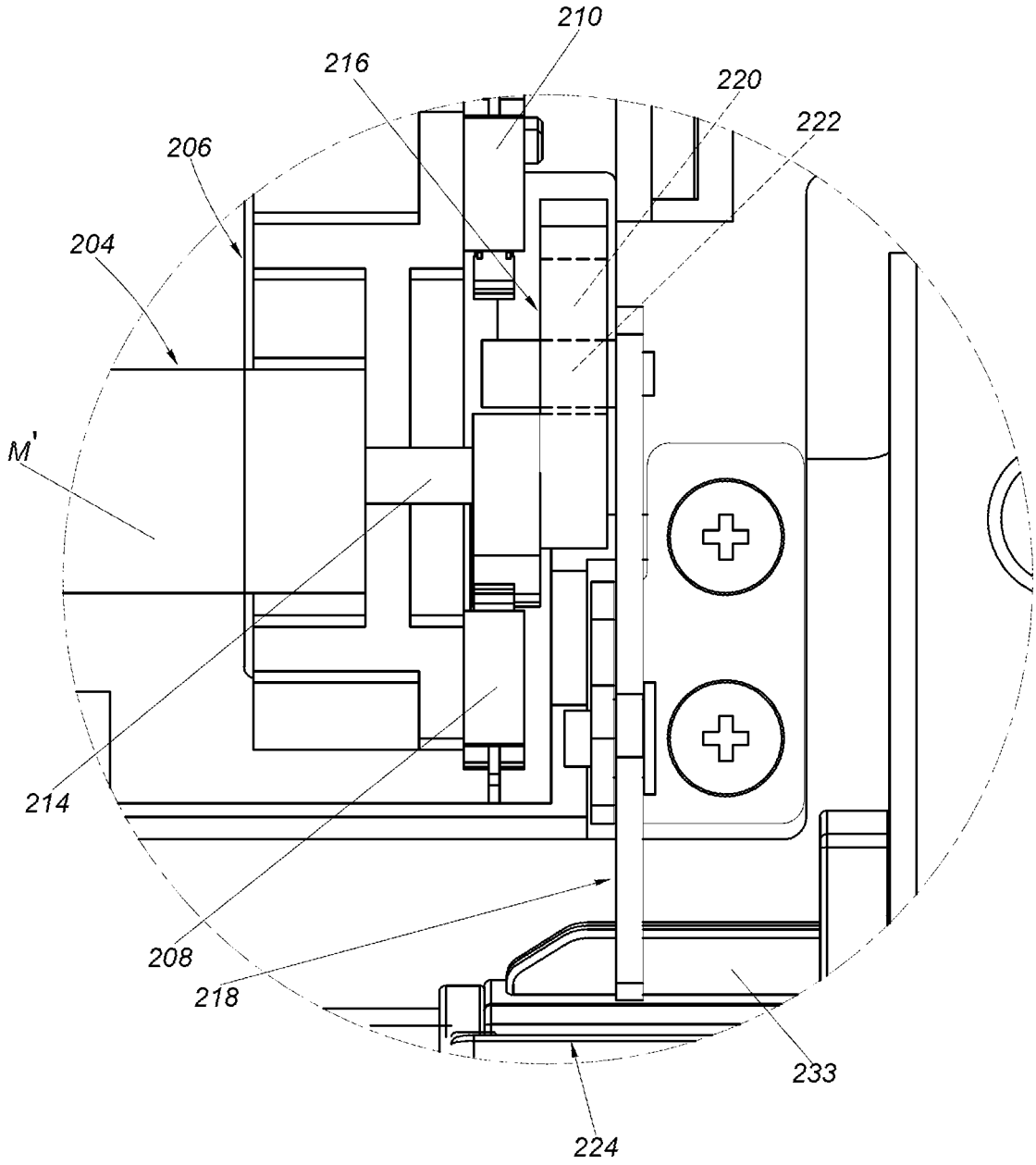
FIG. 10 is an enlarged view of an area A of FIG. 9.

FIG. 9 and FIG. 10 are diagrams showing a slide rail assembly, such as a first slide rail assembly 202 of a furniture system according to a second embodiment of the present invention. In contrast to the first slide rail assembly 22 of the first embodiment, a driving device 204 of the first slide rail assembly 202 has different structural configuration. In addition, an electronic module 206 of the first slide rail assembly 202 is additionally arranged with a motor origin switch 208 and a motor stop switch 210 electrically connected to a control circuit board 212.

Figure 11:
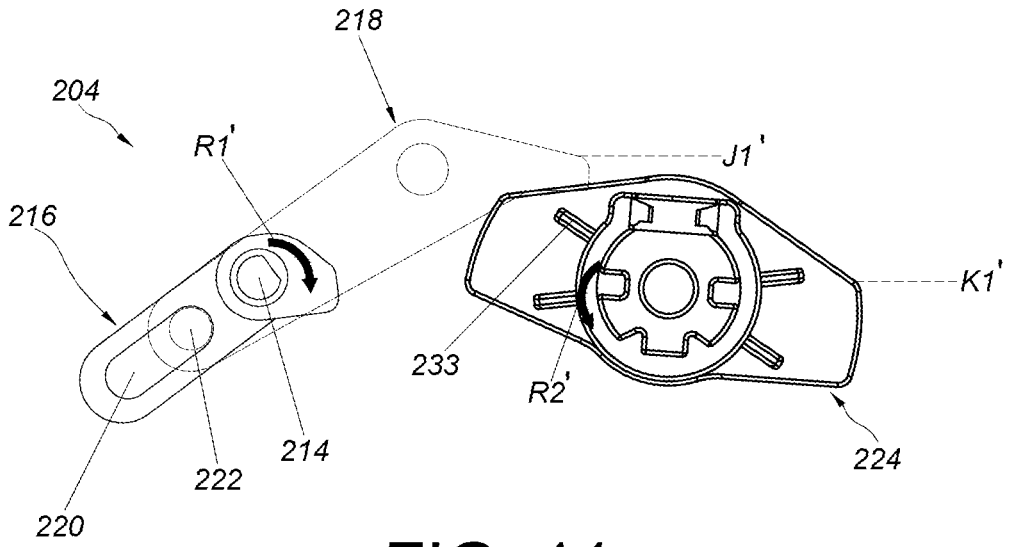
FIG. 11 is a diagram showing at least one driving member of a driving device and a movable member of a synchronization device according to the second embodiment of the present invention.

As shown in FIG. 9 to FIG. 13, the driving device 204 comprises a motor M' (as shown in FIG. 10). In the second embodiment, the motor M' is a direct current motor, such as a direct current gear motor, but the present invention is not limited thereto. A rotating shaft 214 of the motor M' is arranged with a first driving member 216, such as a cam (as shown in FIG. 10 and FIG. 11), but the present invention is not limited thereto. The first driving member 216 is connected to a second driving member 218. The second driving member 218 can be a lever (as shown in FIG. 10 and FIG. 11), but the present invention is not limited thereto. One of the first driving member 216 and the second driving member 218 is formed with an extension slot 220, and the other one of the first driving member 216 and the second driving member 218 is arranged with a connecting pin 222 extended into the extension slot 220 to work with each other (as shown in FIG. 10 and FIG. 11).

The driving device 204 is configured to drive the first movable member 224 to switch from a locking state K1' (as shown in FUG. 11) to an unlocking state K2' (as shown in FUG. 12), in order to release an elastic force F' of an elastic member 226, such that a second rail 228 is moved from a retracted position R' along the opening direction D1 relative to a first rail 230 in response to the elastic force F' of the elastic member 226.

Figure 12:
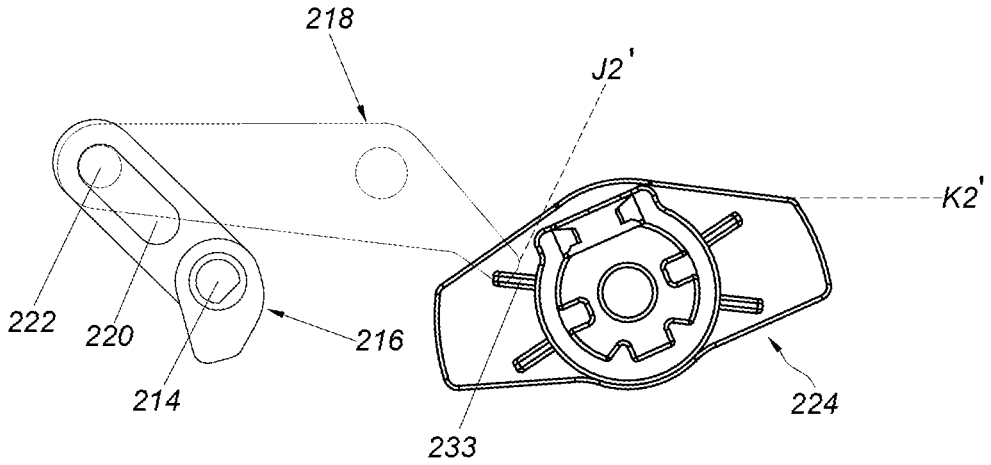
FIG. 12 is a diagram showing the at least one driving member of the driving device driving the movable member of the synchronization device to move according to the second embodiment of the present invention.
Figure 13:
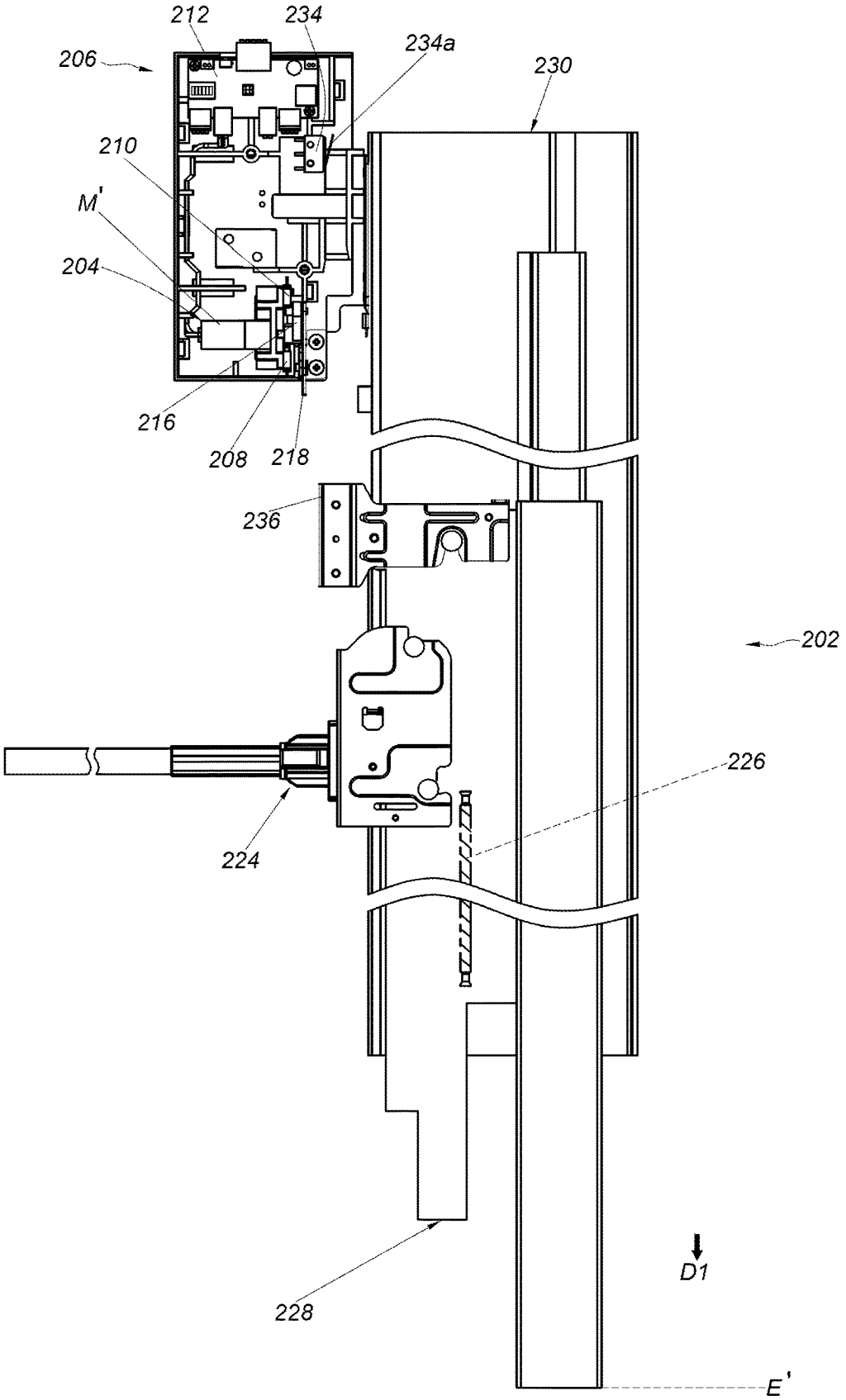
FIG. 13 is a diagram showing the second rail being moved from the retracted position to a predetermined open position relative to the first rail of the slide rail assembly according to the second embodiment of the present invention.

Furthermore, the user can operate a communication device 232 to link to the electronic module 206 (as shown in FIG. 9 and FIG. 10), in order to control the driving device 204 to drive the first movable member 224 to switch from the locking state K1' (as shown in FIG. 11) to the unlocking state K2 (as shown in FIG. 12), such that the second rail 228 is driven to move away from the retracted position R' along the opening direction D1 relative to the first rail 230 in response to the elastic force F' of the elastic member 226. For example, the second rail 228 is correspondingly moved to a predetermined opening position E' (as shown in FIG. 13). More particularly, when the rotating shaft 214 is rotated form the origin position to the stop position to drive the first driving member 216 to rotate, the first driving member 216 and the second driving member 218 are rotated in a same direction, for example, the second driving member 218 is rotated form an initial position J1' (as shown in FIG. 11) along a first rotating direction R1' to a predetermined angle position J2' (as shown in FIG. 12). During such rotating process, the second driving member 218 is configured to contact a working part 233 of the first movable member 224 (as shown in FIG. 12), such that the first movable member 224 is driven to rotate to switch from the locking K1' (as shown in FIG. 11) to the unlocking state K2' (as shown in FIG. 12) through the second driving member 218, in order to release the elastic force F' of the elastic member 226. As such, the second rail 228 is moved from the retracted position R' (as shown in FIG. 9) along the opening direction D1 to the predetermined opening position E' (as shown in FIG. 13) relative to the first rail 230 in response to the elastic force F' of the elastic member 226. In contrast to the first embodiment, the first driving member 216 of the second embodiment is configured to work with the second driving member 218 (such as a lever) in order to increase moment arm, such that the motor M' of the driving device 204 is required to output a smaller force from the rotating shaft 214 for driving the first movable member 224, so as to save power consumption of the driving device 204.

Moreover, the motor origin switch 208 and the motor stop switch 210 are configured to detect positions of the motor M'. For example, the motor origin switch 208 is configured to generate a third signal and a fourth signal. When the rotating shaft 214 of the motor M' is located at the origin position, the second driving member 218 is located at the initial position J1' relative to the rotating shaft 214, and the motor origin switch 208 is configured to generate the third signal; when the rotating shaft 214 of the motor M' is moved away from the origin position, the motor origin switch 208 is configured to generate the fourth signal. On the other hand, the motor stop switch 210 is configured to generate a fifth signal and a sixth signal. When the rotating shaft 214 of the motor M' is located at the stop position, the second driving member 218 is located at the predetermined angle position J2' relative to the rotating shaft 214, and the motor stop switch 210 is configured to generate the fifth signal; when the rotating shaft 214 of the motor M' is moved away from the stop position, the motor stop switch 210 is configured to generate the sixth signal.

Figure 14:
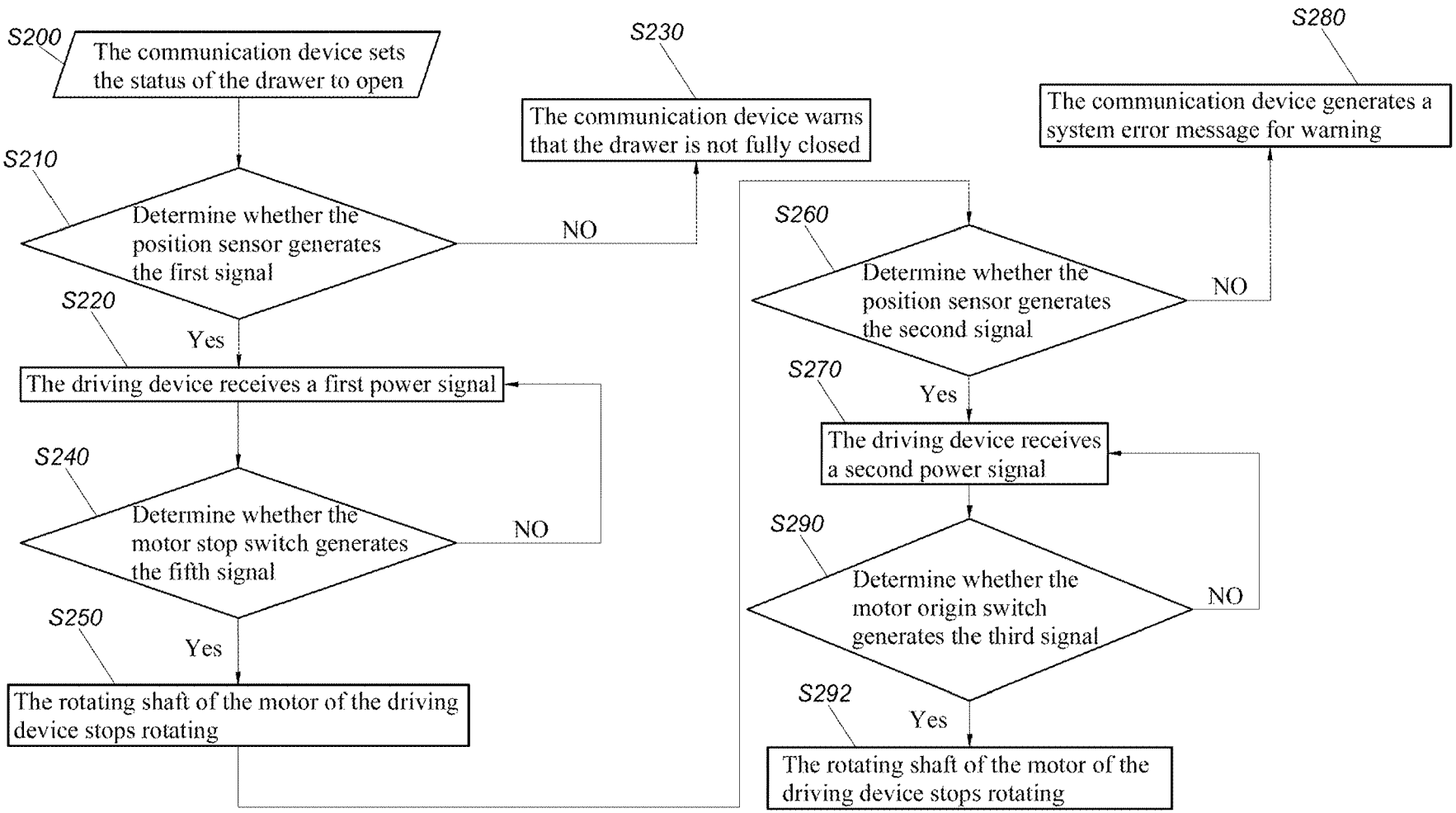
FIG. 14 is a flow chart showing operating processes of a furniture system according to the second embodiment of the present invention.

FIG. 14 is a flow chart showing operating process of the furniture system according to the second embodiment of the present invention. The operating process comprises the following steps:

Step S200: The communication device sets the status of the drawer to open.

In the step S200, the communication device 232 can be installed with an application to link to the electronic module 206 (the control circuit board 212 of the electronic module 206) for wireless communication. The user can transmit a predetermined signal to the electronic module 206 through the communication device 232. As such, the status of the second rail 228 (the drawer) can be set to open.

Step S210: Determine whether the position sensor generates the first signal.

In the step S210, the control circuit board 212 of the electronic module 206 is configured to determine whether the position sensor 234 generates the first signal (as shown in FIG. 9). For example, when a predetermined part 236 of the second rail 228 presses an elastic sensing part 234*a* of the position sensor 234, the position sensor 234 is configured to generate the first signal to the control circuit board 212, to indicate that the second rail 228 (the drawer) is currently located at the retracted position R' relative to the first rail 230 (the cabinet body).

If the control circuit board 212 of the electronic module 206 determines that the position sensor 234 generates the first signal, then go to step S220: The driving device receives a first power signal. In the step S220, when the second rail 228 (the drawer 26) is located at the retracted position R' relative to the first rail 230 (the cabinet body), and when the electronic module 206 receives the predetermined signal from the communication device 232 (as shown in FIG. 9), the control circuit board 212 controls the driving device 204 to receive a first power signal, such that the rotating shaft 214 of the motor M' of the driving device 204 is rotated to the stop position to drive the second driving member 218 to rotate to the predetermined angle position J2' (as shown in FIG. 12), in order to further drive the first movable member 224 to switch to the unlocking state K2' (as shown in FIG. 12), so as to release the elastic force F' of the elastic member 226.

If the control circuit board 212 of the electronic module 206 determines that the position sensor 234 does not generate the first signal, then go to step S230: The communication device warns that the drawer is not fully closed. In the step S230, if the position sensor 234 does not generate the first signal, the control circuit board 212 is configured to notify the communication device 232 to generate a warning sound and/or an electronic message through the application to let the user know that the second rail 228 (the drawer) currently is not located at the retracted position R' relative to the first rail 230 (the cabinet body).

Preferably, after the step S220, go to step S240: Determine whether the motor stop switch generates the fifth signal. In the step 240, the control circuit board 212 of the electronic module 206 is configured to determine whether the motor stop switch 210 generates the fifth signal, in order to determine whether the rotating shaft 214 of the motor M' of the driving device 204 is located at the stop position (or whether the second driving member 218 is located at the predetermined angle position J2') as shown in FIG. 12.

If the control circuit board 212 of the electronic module 206 determines that the motor stop switch 210 generates the fifth signal, then go to step S250: The rotating shaft of the motor of the driving device stops rotating. In the step S250, if the control circuit board 212 of the electronic module 206 determines that the motor stop switch 210 generates the fifth signal, the rotating shaft 214 of the motor M' of the driving device 204 stops at the stop position (the second driving member 218 stops at the predetermined angle position J2' as shown in FIG. 12). If the control circuit board 212 of the electronic module 206 determines that the motor stop switch 210 does not generate the fifth signal, then return to step S220.

Furthermore, after the step S250, go to step S260: Determine whether the position sensor generates the second signal. In the step S260, the control circuit board 212 of the electronic module 206 is configured to determine whether the position sensor 234 generates the second signal (as shown in FIG. 13). For example, when the predetermined part 236 of the second rail 228 does not press the elastic sensing part 234*a* of the position sensor 234, the position sensor 234 is configured to generate the second signal to the control circuit board 212, to indicate that the second rail 228 (the drawer) is currently moved away from the retracted position R' (or located at the predetermined opening position E') relative to the first rail 230 (the cabinet body) in response to the elastic F' of the elastic member 226.

If the control circuit board 212 of the electronic module 206 determines that the position sensor 234 generates the second signal, then go to step S270: The driving device receives a second power signal. In the step S270, when the position sensor 234 generates the second signal, the control circuit board 212 controls the driving device 204 to receive the second power signal, such that the rotating shaft 214 of the motor M' of the driving device 204 is rotated back to the origin position, in order to drive the second driving member 218 to correspondingly rotate to the initial position J1' (please refer to FIG. 11).

If the control circuit board 212 of the electronic module 206 determines that the position sensor 234 does not generate the second signal, then go to step S280: The communication device generates a system error message for warning. In the step S280, if the position sensor 234 does not generate the second signal, it means that the second rail 228 (the drawer) is not moved away from the retracted position R'. The control circuit board 212 is configured to notify the communication device 232 to generate a system error message, such as a warning sound and/or an electronic message, through the application to let the user know that the second rail 228 (the drawer) currently is not moved away from the retracted position R'.

Preferably, after the step S270, go to step S290: Determine whether the motor origin switch generates the third signal. In the step S290, the control circuit board 212 of the electronic module 206 is configured to determine whether the motor origin switch 208 generates the third signal, in order to further determine whether the rotating shaft 214 of the motor M' of the driving device 204 is located at the origin position (or whether the second driving member 218 is located at the initial position J1') as shown in FIG. 11.

If the control circuit board 212 of the electronic module 206 determines that the motor origin switch 208 generates the third signal, then go to step S292: The rotating shaft of the motor of the driving device stops rotating. In the step S292, if the control circuit board 212 of the electronic module 206 determines that the motor origin switch 208 generates the third signal, the rotating shaft 214 of the motor M' of the driving device 204 stops at the origin position, and the second driving member 218 correspondingly stops at the initial position J1' (as shown in FIG. 11). Meanwhile, it means that the drawer has been opened. Furthermore, when the position sensor 234 generates the second signal and the motor origin switch 208 generates the third signal, it means that the furniture system has completed the operation of opening the second rail 228 (drawer). If the control circuit board 212 of the electronic module 206 determines that the motor origin switch 208 does not generate the third signal, then return to step S270.

Therefore, the slide rail assembly according to the embodiments of the present invention has the following technical features:

1. The driving device (51, 204) of the electronic module (48, 206) is configured to drive the movable member (42, 224) to switch to the unlocking state (K1, K1'), in order to release the elastic force (F, F') of the elastic member (68, 226), such that the second rail (32, 228) can be moved from the retracted position (R, R') to the predetermined opening position (E, E') along the opening direction D1 relative to the first rail (30, 230) in response to the elastic force (F, F') of the elastic member (68, 226).
2. The second rail (32, 228) or the drawer 26 of the furniture system can be opened through electric driving (not through manual pressing as in the prior art). The user can operate the communication device (74, 232) to link to the electronic module (48, 206) for wireless communication in order to automatically open the second rail (32, 228) or the drawer 26, so as to facilitate the user to manage the items in the drawer 26.
3. The electronic module (48, 206) is detachably mounted to the first rail (32, 230). Therefore, the electronic module (48, 206) can be additionally installed to the furniture system (20) according to requirements, such that the furniture system 20 has the function of automatically opening the second rail (32, 228) or the drawer 26 through electric driving.
4. In contrast to the first embodiment, the first driving member 216 of the driving device 204 of the second embodiment is configured to work with the second driving member 218 (such as a lever) in order to increase moment arm, such that the motor M' of the driving device 204 is required to output a smaller force from the rotating shaft 214 for driving the first movable member 224, so as to save power consumption of the driving device 204.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A slide rail assembly, comprising:

a first rail;

a second rail movable relative to the first rail;

an elastic member configured to generate an elastic force in response to the second rail being located at a retracted position relative to the first rail;

a movable member, wherein when the second rail is located at the retracted position relative to the first rail and when the movable member is in a locking state, the elastic member is configured to be locked to accumulate the elastic force; and an electronic module comprising a driving device configured to drive the movable member to switch from the locking state to an unlocking state, in order to release the elastic force of the elastic member, such that the second rail is moved from the retracted position along an opening direction relative to the first rail in response to the elastic force of the elastic member;

wherein the movable member is rotatably mounted on the second rail.

2. The slide rail assembly of claim 1, wherein the movable member is configured to be connected to a synchronization rod, and the synchronization rod is connected to a second rail of another slide rail assembly.

3. The slide rail assembly of claim 1, wherein the electronic module is detachably mounted on the first rail.

4. The slide rail assembly of claim 3, wherein the electronic module further comprises a position sensor configured to detect whether the second rail is located at the retracted position relative to the first rail.

5. The slide rail assembly of claim 3, wherein the electronic module further comprises a control circuit board, the driving device is electrically connected to the control circuit board, and the driving device comprises a motor, a rotating shaft of the motor is arranged with a driving member, the rotating shaft is configured to drive the driving member to rotate, in order to further drive the movable member to rotate to switch from the locking state to the unlocking state, so as to release the elastic force of the elastic member.

6. The slide rail assembly of claim 5, wherein the motor is a servo motor.

7. The slide rail assembly of claim 3, wherein the electronic module further comprises a control circuit board, the driving device is electrically connected to the control circuit board, and the driving device comprises a motor, a rotating shaft of the motor is arranged with a first driving member, the first driving member is connected to a second driving member, one of the first driving member and the second driving member is formed with an extension slot, the other one of the first driving member and the second driving member is arranged with a connecting pin extended into the extension slot, the rotating shaft is configured to drive the first driving member to rotate, such that the first driving member and the second driving member are rotated in a same direction, in order to further drive the movable member to rotate to switch from the locking state to the unlocking state through the second driving member, so as to release the elastic force of the elastic member.

8. The slide rail assembly of claim 7, wherein the electronic module further comprises a motor origin switch and a motor stop switch configured to detect positions of the motor.

9. The slide rail assembly of claim 8, wherein the motor is a direct current motor.

10. A method for opening a slide rail of a slide rail assembly, comprising:

providing a slide rail assembly comprising a first rail, a second rail and an elastic member;

providing a movable member in a locking state arranged on the second rail to lock the elastic member in order to accumulate an elastic force of the elastic member;

providing an electronic module arranged on the first rail, wherein the electronic module comprises a driving device; and linking a communication device to the electronic module to control the driving device to drive the movable member to switch to an unlocking state, in order to release the elastic force of the elastic member, such that the second rail is moved away from a retracted position relative to the first rail in response to the elastic force of the elastic member.

11. The method of claim 10, wherein the first rail is configured to be mounted to a cabinet body, and the second rail is configured to carry a drawer.

12. The method of claim 11, wherein the communication device and the electronic module are linkable to each other for communication.

13. The method of claim 12, wherein the communication device and the electronic module are wirelessly linkable to each other for communication.

14. The method of claim 10, wherein the movable member is rotatably mounted on the second rail.

15. The method of claim 10, wherein the electronic module is detachably mounted on the first rail.

16. The method of claim 15, wherein the electronic module further comprises a position sensor, the method further comprises the position sensor detecting whether the second rail is located at the retracted position relative to the first rail.

17. The method of claim 15, wherein the electronic module further comprises a control circuit board and a motor, the driving device comprises the motor, a rotating shaft of the motor is arranged with a driving member, the method further comprises the rotating shaft driving the driving member to rotate, in order to further drive the movable member to rotate to switch from the locking state to the unlocking state, so as to release the elastic force of the elastic member.

18. The method of claim 15, wherein the electronic module further comprises a control circuit board and a motor, the driving device comprises the motor, a rotating shaft of the motor is arranged with a first driving member, the first driving member is connected to a second driving member, one of the first driving member and the second driving member is formed with an extension slot, the other one of the first driving member and the second driving member is arranged with a connecting pin extended into the extension slot, the method further comprises the rotating shaft driving the first driving member to rotate, such that the first driving member and the second driving member are rotated in a same direction, in order to further drive the movable member to rotate to switch from the locking state to the unlocking state through the second driving member, so as to release the elastic force of the elastic member.

19. The method of claim 18, wherein the electronic module further comprises a motor origin switch and a motor stop switch, the method further comprises the motor origin switch and the motor stop switch detecting positions of the motor.

20. A slide rail assembly, comprising:

a first rail;

a second rail movable relative to the first rail;

an elastic member configured to generate an elastic force in response to the second rail being located at a retracted position relative to the first rail;

a movable member, wherein when the second rail is located at the retracted position relative to the first rail and when the movable member is in a locking state, the elastic member is configured to be locked to accumulate the elastic force; and an electronic module comprising a driving device configured to drive the movable member to switch from the locking state to an unlocking state, in order to release the elastic force of the elastic member, such that the second rail is moved from the retracted position along an opening direction relative to the first rail in response to the elastic force of the elastic member;

wherein the electronic module is detachably mounted on the first rail.

* * * * *